US007357182B2

(12) United States Patent
Hunt et al.

(10) Patent No.: US 7,357,182 B2
(45) Date of Patent: Apr. 15, 2008

(54) METHOD AND APPARATUS FOR COMPLETING LATERAL CHANNELS FROM AN EXISTING OIL OR GAS WELL

(75) Inventors: John R. Hunt, Madisonville, KY (US); Henry B. Mazorow, Lorain, OH (US)

(73) Assignee: Horizontal Expansion Tech, LLC, Lorain, OH (US)

( * ) Notice: Subject to any disclaimer, the term of this patent is extended or adjusted under 35 U.S.C. 154(b) by 91 days.

(21) Appl. No.: 11/121,622

(22) Filed: May 4, 2005

(65) Prior Publication Data

US 2005/0247451 A1 Nov. 10, 2005

Related U.S. Application Data

(60) Provisional application No. 60/568,492, filed on May 6, 2004, provisional application No. 60/573,013, filed on May 20, 2004.

(51) Int. Cl.
*E21B 43/11* (2006.01)

(52) U.S. Cl. ..... 166/298; 166/313; 166/50

(58) Field of Classification Search ..... 166/313, 166/298, 117.5, 50

See application file for complete search history.

(56) References Cited

U.S. PATENT DOCUMENTS

| | | | | |
|---|---|---|---|---|
| 1,904,819 | A | 4/1933 | Blodgett | |
| 2,521,976 | A | 9/1950 | Hays | |
| 4,007,797 | A | 2/1977 | Jeter | |
| 4,346,761 | A * | 8/1982 | Skinner et al. | 166/206 |
| 4,431,069 | A | 2/1984 | Dickinson, III et al. | |
| 4,474,252 | A | 10/1984 | Thompson | |
| 4,479,541 | A * | 10/1984 | Wang | 166/268 |
| 4,497,381 | A | 2/1985 | Dickinson et al. | |
| 4,501,337 | A | 2/1985 | Dickinson et al. | |
| 4,527,639 | A | 7/1985 | Dickinsonk, III et al. | |
| 4,637,479 | A | 1/1987 | Leising | |
| 4,640,362 | A | 2/1987 | Schellstede | |
| 4,646,831 | A | 3/1987 | Marsh et al. | |
| 4,658,916 | A | 4/1987 | Bond | |
| 4,735,501 | A | 4/1988 | Ginsburgh et al. | |

(Continued)

FOREIGN PATENT DOCUMENTS

| | | |
|---|---|---|
| GB | 2284837 | 6/1995 |

(Continued)

OTHER PUBLICATIONS

Bozidar Omircen, et al., "Application and Results of Petro Jet® Multilateral Drilling in Croatia" PJMLS: Oct. 2001, Int'l Conf., pp. 1-22.

*Primary Examiner*—William P Neuder
(74) *Attorney, Agent, or Firm*—Pearne & Gordon LLP

(57) ABSTRACT

A method and apparatus for completing a lateral channel from an existing oil or gas well includes a well perforating tool for perforating a well casing at a preselected depth, and a lateral alignment tool for directing a flexible hose and blaster nozzle through a previously made perforation in the casing to complete the lateral channel. The disclosed apparatus eliminates the need to maintain the precise alignment of a downhole "shoe" in order to direct the flexible hose and blaster nozzle through a previously made perforation through the well casing.

17 Claims, 7 Drawing Sheets

U.S. PATENT DOCUMENTS

| | | | |
|---|---|---|---|
| 4,763,734 | A | 8/1988 | Dickinson et al. |
| 4,786,874 | A | 11/1988 | Grosso et al. |
| 4,842,487 | A | 6/1989 | Buckman et al. |
| 4,930,586 | A | 6/1990 | Turin et al. |
| 4,947,944 | A | 8/1990 | Coltman et al. |
| 4,991,667 | A | 2/1991 | Wilkes et al. |
| 5,006,046 | A | 4/1991 | Buckman et al. |
| 5,148,877 | A | 9/1992 | MacGregor |
| 5,165,491 | A | 11/1992 | Wilson |
| 5,194,859 | A | 3/1993 | Warren |
| 5,210,533 | A | 5/1993 | Summers et al. |
| 5,255,750 | A | 10/1993 | Wilkes et al. |
| 5,318,121 | A | 6/1994 | Brockman et al. |
| 5,363,927 | A | 11/1994 | Frank |
| 5,394,951 | A | 3/1995 | Pringle et al. |
| 5,396,966 | A | 3/1995 | Roos, Jr. et al. |
| 5,402,855 | A | 4/1995 | Gondouin |
| 5,410,303 | A | 4/1995 | Comeau et al. |
| 5,413,184 | A | 5/1995 | Landers |
| 5,439,066 | A | 8/1995 | Gipson |
| 5,458,209 | A | 10/1995 | Hayes et al. |
| 5,528,566 | A | 6/1996 | McGee et al. |
| 5,553,680 | A | 9/1996 | Hathaway |
| RE35,386 | E | 12/1996 | Wu et al. |
| 5,626,508 | A | 5/1997 | Rankin et al. |
| 5,687,806 | A | 11/1997 | Sallwasser et al. |
| 5,853,056 | A | 12/1998 | Landers |
| 5,892,460 | A | 4/1999 | Jerabek et al. |
| 5,899,958 | A | 5/1999 | Dowell et al. |
| 5,934,390 | A | 8/1999 | Uthe |
| 5,987,385 | A | 11/1999 | Varsamis et al. |
| 6,109,370 | A | 8/2000 | Gray |
| 6,125,949 | A | 10/2000 | Landers |
| 6,257,353 | B1 | 7/2001 | Belew et al. |
| 6,263,984 | B1 | 7/2001 | Buckman, Sr. |
| 6,352,109 | B1 | 3/2002 | Buckman, Sr. |
| 6,470,978 | B2 | 10/2002 | Trueman et al. |
| 6,488,082 | B2 | 12/2002 | Echols et al. |
| 6,530,439 | B2 | 3/2003 | Mazorow |
| 6,578,636 | B2 | 6/2003 | Mazorow et al. |
| 6,668,948 | B2 | 12/2003 | Buckman, Sr. et al. |
| 6,889,781 | B2 | 5/2005 | Mazorow |
| 6,964,303 | B2 | 11/2005 | Mazorow et al. |
| 2001/0045282 | A1* | 11/2001 | Robinson ..... 166/298 |
| 2001/0045300 | A1 | 11/2001 | Fincher et al. |

FOREIGN PATENT DOCUMENTS

| | | |
|---|---|---|
| WO | WO 9749889 | 12/1997 |

* cited by examiner

METHOD AND APPARATUS FOR COMPLETING LATERAL CHANNELS FROM AN EXISTING OIL OR GAS WELL

CROSS-REFERENCE TO RELATED APPLICATIONS

This application claims the benefit of U.S. Provisional Application No. 60/568,492 filed May 6, 2004, and U.S. Provisional Application No. 60/573,013 filed May 20, 2004, the disclosures of which are incorporated herein by reference.

BACKGROUND OF THE INVENTION

1. Field of the Invention

The invention relates to methods and apparatus for completing lateral channels from existing oil or gas wells. More particularly, it relates to improved methods and apparatus for penetrating the well casing of an existing well at a given depth, and completing one or more laterals at that depth.

2. Description of Related Art

Oil and gas are produced from wells drilled from the earth surface into a hydrocarbon "payzone." Once a well is drilled, it essentially is a hole in the earth extending from the earth surface downward several hundred or thousand feet into or adjacent a hydrocarbon payzone. The thus drilled hole generally is not very stable because, among other things, its earthen walls are highly subject to erosion or shifting over time, whether due to the flow of hydrocarbons to the surface, or other natural causes such as water erosion from rain or flooding. This is especially of concern considering many oil and gas wells stay online for several or tens of years, or longer.

To impart stability to a drilled well, it is conventional to encase the well bore with a casing material, typically made from steel. The steel well casing essentially is a cylindrical-walled pipe having an OD somewhat smaller than the ID of the well bore drilled from the earth surface. The well casing is placed down in the well bore, typically in discrete sections which are secured or otherwise joined together as is known in the art. Once the well casing is in place centrally within the earthen well bore, it is conventional to fill in the thus-defined annular space between the well casing and the well bore with cement.

The resulting construction is an oil or gas well consisting of a cement-encased steel pipe extending from the earth surface down into a hydrocarbon payzone from which hydrocarbons (oil and/or gas) can be extracted and delivered to the surface via conventional techniques. This steel pipe, also called the well casing, defines an inner bore or passageway for the delivery of hydrocarbons to the surface. The described construction has proven useful for decades to produce oil or gas from hydrocarbon payzones located at, or which empty into, the base (bottom end) of the well casing. However, once these payzones dry up, either the well must be abandoned or it must be treated in order to make it productive and profitable once again.

There are several conventional treatment techniques for revitalizing an otherwise unproductive well. Two of the most common are referred to as acidizing and fracturizing. Both of these techniques are designed to increase the adjacent formation's porosity by producing channels in the formation allowing hydrocarbons to flow more easily into the perforated well bore, thereby increasing the well's production and its value. However, the success of these operations is highly speculative and both are very expensive and require dedicated heavy equipment and a large crew.

A more efficient technique for stimulating a diminished production well is to drill a hole through the well casing at a depth below the earth surface, and then to bore a lateral channel through the predrilled hole into an adjacent payzone using a high pressure water jet nozzle (blaster nozzle). Various techniques and apparatus for boring lateral channels downhole are known in the art, for example as described in U.S. Pat. Nos. 6,530,439, 6,578,636, 6,668,948, and 6,263,984, the contents of all of which are incorporated herein by reference. Generally, an elbow or "shoe" is used downhole to redirect a cutting tool fed from the surface along a radial or lateral path at a depth at which a lateral channel is to be completed. The cutting tool is directed laterally against the well casing to cut or drill a small hole through the casing and the cement encasement beyond, and is then withdrawn to make way for a separate blaster nozzle and associated high pressure water hose that must be snaked through the previously drilled hole. This technique, which is simple to describe, in practice can be difficult to perform, with uncertain or irreproducible results.

For one thing, often it is difficult and sometimes even impossible to determine with certainty that a hole actually has been cut through the casing and the cement encasement. Also, even assuming a successfully cut hole, it can be extremely difficult to ensure accurate alignment of the elbow or downhole shoe in order to direct the blaster nozzle through the previously cut hole. For example, the shoe may be jerked or moved during withdrawal of the cutting tool or insertion of the blaster nozzle. In addition, it is extraordinarily difficult, if not impossible in most cases to realign the shoe with a previously cut hole if the shoe alignment is accidentally shifted, or if it must be shifted (e.g. to drill another hole) subsequent to drilling the hole in the casing but prior to feeding the blaster nozzle through the hole. Often it is impossible to know at the surface if the alignment of the shoe with the previously drilled hole has been disturbed and needs readjustment.

There is a need in the art for a method of perforating the well casing (and annular cement encasement) at depth within an existing oil or gas well, wherein the precise alignment of a downhole tool need not be exactly maintained to ensure a subsequently introduced boring tool, such as a high pressure blaster nozzle, can be directed through the previously made perforation to bore a lateral channel or channels therefrom.

SUMMARY OF THE INVENTION

A well perforating tool is provided. The well perforating tool has a substantially cylindrical body defining a circumferential wall of the perforating tool. The well perforating tool has a longitudinal axis and includes an axial blind bore open to a proximal end of the perforating tool and defining an axial flow passage within the perforating tool. At least one lateral port is located in the circumferential wall of the perforating tool. The lateral port provides fluid communication between the axial flow passage and a position exterior of the perforating tool. The lateral port is adapted to accommodate a jet of high pressure cutting fluid for perforating a well casing.

A lateral channel alignment tool is provided, which includes a substantially elongate basic body having a longitudinal axis, a lateral alignment member pivotally attached to the basic body, and a biasing mechanism effective to bias the lateral alignment member in an angled or laterally engaged position relative to the basic body. The basic body has a longitudinal passage therethrough adapted to accommodate a hose therein. The lateral alignment member includes a first portion that extends generally lengthwise, a terminal portion that extends at an angle relative to the lengthwise direction of the first portion, and an elbow-shaped passage provided within the lateral alignment member. The elbow-shaped passage extends through the respective first and terminal portions of the lateral alignment member from an entrance located in the first portion to an exit located in the terminal portion, with the entrance of the elbow-shaped passage being located adjacent a distal end of the longitudinal passage in the basic body, and being adapted to receive a blaster nozzle and associated hose therefrom.

A method of completing a lateral channel from an existing oil or gas well having a well casing is provided, including the steps of: providing a well perforating tool having a substantially cylindrical body defining a circumferential wall of the perforating tool, the perforating tool having a longitudinal axis and including an axial blind bore open to a proximal end of the perforating tool and defining an axial flow passage within the perforating tool, and at least one lateral port located in the circumferential wall of the perforating tool, wherein the lateral port provides fluid communication between the axial flow passage and a position exterior of the perforating tool; suspending the well perforating tool at a selected depth in the existing well; and pumping a fluid at high pressure through said axial flow passage such that a jet of the high pressure fluid shoots out from the lateral port to make a perforation in the well casing.

A further method of completing a lateral channel from an existing oil or gas well having a well casing is provided, which includes the steps of: providing a lateral channel alignment tool including a substantially elongate basic body having a longitudinal axis, a lateral alignment member pivotally attached to the basic body, and a biasing mechanism effective to bias the lateral alignment member in an angled or laterally engaged position relative to the basic body, wherein the basic body has a longitudinal passage therethrough adapted to accommodate a hose therein, and wherein the lateral alignment member includes a first portion that extends generally lengthwise, a terminal portion that extends at an angle relative to the lengthwise direction of the first portion, and an elbow-shaped passage provided within the lateral alignment member, the elbow-shaped passage extending through the respective first and terminal portions of the alignment member from an entrance located in the first portion to an exit located in the terminal portion, wherein the entrance of said elbow-shaped passage is located adjacent a distal end of the longitudinal passage in the basic body and is adapted to receive a blaster nozzle and associated hose therefrom; and providing and directing a flexible hose, having a blaster nozzle attached at its distal end, through the elbow-shaped passage in the lateral alignment member, out through the exit thereof and into engagement with earth strata beyond to cut a lateral channel through the strata from the existing well.

DETAILED DESCRIPTION OF PREFERRED EMBODIMENTS

As used herein, when a range such as 5 to 25 (or 5-25) is given, this means preferably at least 5 and, separately and independently, preferably not more than 25. Also as used herein, when referring to a tool used downhole in a well, such as the perforating tool 100, the lateral channel alignment tool 200, or the flexible hose assembly 10 described below, the proximal end of the tool is the end nearest the earth surface when being used, and the distal end of the tool is the end farthest from the earth surface when being used; i.e. the distal end is the end inserted first into the well. Also as used herein, a bore (such as a through bore or a blind bore) need not be made, necessarily, by drilling. It can be formed by any suitable method or means for the removal of material, for example, by drilling or cutting, or by casting or molding an object to have a bore.

Figure 1:
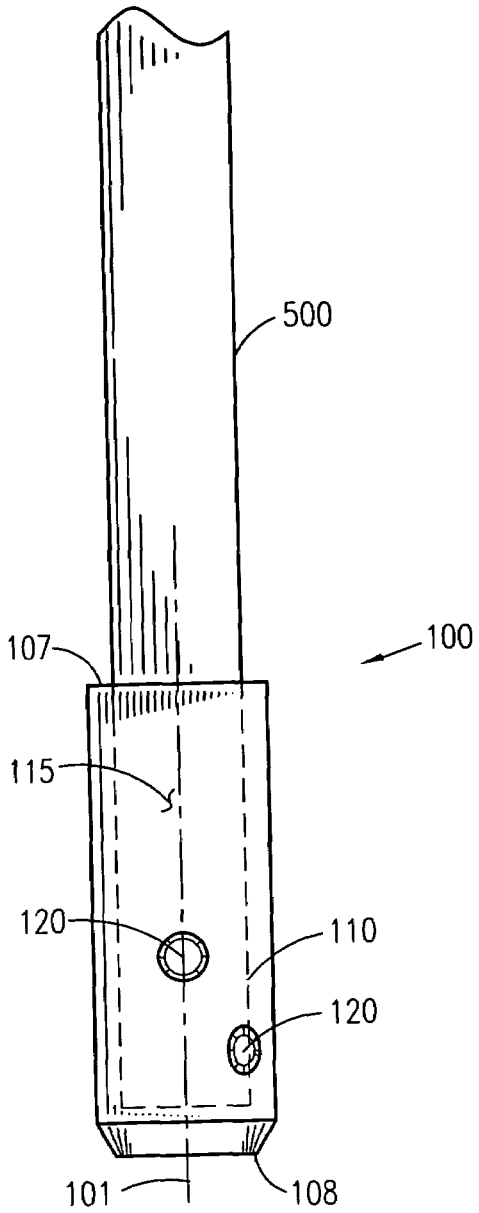
FIG. 1 is a side view of a well perforating tool.
Figure 2:
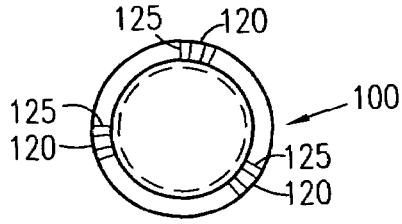
FIG. 2 is an end view of the well perforating tool of FIG. 1.
Figure 3:
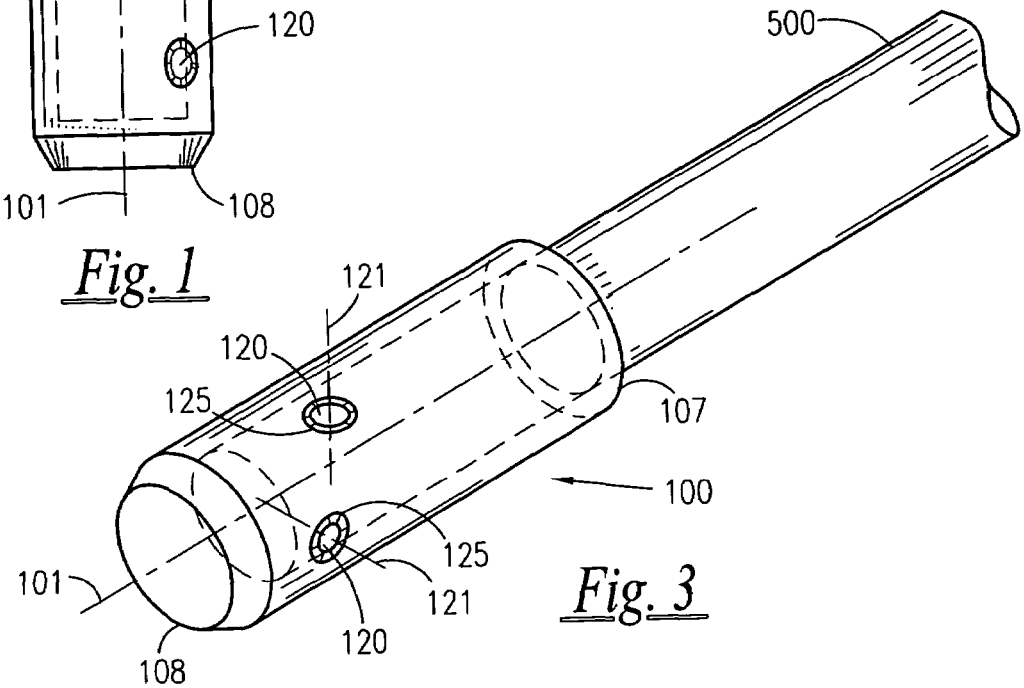
FIG. 3 is a side perspective view of the well perforating tool of FIG. 1.

Referring to FIGS. 1-3, a well perforating tool 100 and a lateral channel alignment tool 200 (FIG. 4*a*) are provided. When used together according to methods described herein, these tools are useful to reproducibly complete lateral channels from an existing oil or gas well at a desired depth, without having to maintain the precise alignment of any downhole equipment between a well perforating operation and a subsequent lateral channel boring operation. First the structure of each of these tools is described. Following is a description of methods for completing lateral channels from an existing well, for example using a flexible hose assembly as described herein.

The well perforating tool 100 has a substantially cylindrical body having a longitudinal axis 101, preferably made from steel or stainless steel, most preferably from 4140 steel. The perforating tool 100 has an axial blind bore 110 open to, preferably drilled from, the proximal end 107 of the tool 100, preferably extending substantially the entire length of the tool 100, but not through the distal end 108. The blind bore 110 defines an axial flow passage 115 within the perforating tool 100 to accommodate a high pressure abrasive cutting fluid as described below. Less preferably, the bore 110 can be a through bore drilled through the distal end 108 of the perforating tool 100, though this will have a substantially negative effect on the pressure of the cutting fluid used to perforate the well casing as will become evident below.

The perforating tool 100 preferably is machined at its proximal end 107 adjacent the opening for blind bore 110, to accommodate or be mated to the end of a length of upset tubing 500 as is known in the art. The exact means for attaching the upset tubing 500 to the proximal end of the perforating tool 100 are not critical, and can employ any known or conventional means for attaching upset tubing to downhole drilling equipment, which means are well known by those skilled in the art, so long as the following conditions are taken into consideration. First, the means employed should provide fluid tightness between the tubing 500 and the tool 100 at high internal fluid pressure, preferably at least 2500, preferably at least 3000, preferably at least 3500, preferably at least 4000, preferably at least 4500, preferably at least 5000, preferably at least 6000, preferably at least 8000, preferably at least 10,000, psi. By fluid tightness, it is not intended or implied that there cannot be any fluid leaking out of the tubing-perforating tool juncture or through the attachment means at the above fluid pressures, or even that substantial fluid cannot leak out; only that the fluid pressure in the axial flow passage 115 is not thereby diminished by more than about 40, preferably 30, preferably 20, preferably 10, preferably 5, percent. Second, the means for attaching the upset tubing 500 to the perforating tool 100 should be able to withstand rotational or torsional stresses downhole, e.g. at a depth of 50-5000 feet or more, based on rotating the upset tubing at the surface at a rate of about 10-500, more preferably 15-100 RPMs. This is because, as will be further described, the perforating tool 100 is caused to rotate downhole by rotating the upset tubing at the surface. Exemplary attachment means include threaded connections, snap-type or locking connections that are or may be sealed using gaskets, O-rings, and the like.

Preferably, the distal end 108 of the perforating tool 100 is chamfered to promote smooth insertion into and passage through the well casing. Optionally, the proximal end 107 can be chamfered as well to promote smooth retraction and withdrawal of the perforating tool 100 from the well casing following a well perforating operation.

The perforating tool 100 has at least one, and preferably has a plurality of lateral ports 120 located in the circumferential wall of the tool 100. Preferably, each port 120 is provided with an abrasion resistant insert 125 that has a port hole provided or drilled therethrough, and which is inserted and accommodated within an aperture drilled or punched substantially radially through the circumferential wall of the perforating tool 100. The lateral ports 120 provide fluid communication between the axial flow passage 115 and a position exterior the perforating tool 100, and are passageways for jets of the high pressure abrasive cutting fluid used to perforate the well casing as will be further described. The inserts 125 are resistant to abrasion or erosion from the cutting fluid which is the reason they are used. The ports 120 can be provided by first inserting solid inserts 125 made from carbide or other resistant material into predrilled apertures in the circumferential wall of the tool 100, and then drilling port holes through the inserts. Alternatively, the inserts 125 can have the port holes predrilled therein prior to being inserted in the apertures of the perforating tool 100 wall.

Preferably, the abrasion resistant inserts 125 are made from carbide material, most preferably from tungsten carbide. Less preferably, the abrasion resistant inserts 125 can be made from another suitable or conventional abrasion resistant material that is effective to withstand the high pressure abrasive cutting fluid that will be jetted through the ports 120, with little or substantially no erosion of the inserts 125 following 2, 3, 4, 5, 6, 7, 8, 9 or 10, well perforating operations (described below). However, it should be understood the inserts 125 (even those made from tungsten carbide) eventually will erode from the abrasive cutting fluid to the point that either the inserts 125 or the entire perforating tool 100 should be replaced.

The lateral ports 120 are of minor diameter compared to the diameter of the perforating tool 100, preferably not more than 20 or 15 percent the OD of the perforating tool, most preferably not more than 12, 10, 8, 6 or 5, percent the OD of the perforating tool.

In operation, the perforating tool 100 is rotated downhole via the upset tubing 500 from the surface, and the high pressure abrasive cutting fluid is pumped through the axial flow passage 115 and jetted out the lateral ports 120 to perforate the well casing at the desired depth. Therefore, it is desired the tool 100 be designed to be substantially balanced during a perforating operation. By balanced, it is meant that when the tool 100 is rotated within the well casing as high pressure cutting fluid is jetted out from the lateral ports 120, the perforating tool 100 rotates uniformly about its longitudinal axis without being thrust against the surrounding well casing. To achieve such a balanced design, preferably the plurality of ports 120 are provided 1) having substantially equal diameters and spaced circumferentially apart from one another according to the following relation when viewed along the longitudinal axis 101 of the perforating tool 100:

$$\text{circumferential spacing of ports} = 2\pi\text{radians}/(\text{number of ports})$$

resulting in a circumferential spacing of $\pi$ radians for 2 ports, $2\pi/3$ radians for 3 ports, $\pi/2$ radians for 4 ports, etc.; and 2) such that each port 120 is radially aligned with the perforating tool 100 so that a centerline 121 of each port 120 intersects the longitudinal axis 101 of the perforating tool 100.

When the ports 120 are provided as described in the preceding paragraph, the sum of the lateral thrust vectors resulting from the cutting fluid jetting out the ports 120 is substantially zero. Thus, the principal net force acting on the perforating tool 100 during a perforating operation is the rotational force or torque supplied via the upset tubing from the surface, and substantially no net lateral thrust or force moments act on the tool 100 as a result of the fluid jetting from lateral ports 120. Therefore, the perforating tool 100 is permitted to rotate freely within the well casing based on the torque supplied from the upset tubing 500, without substantially binding or seizing against the well casing as it is rotated.

Figure 7:
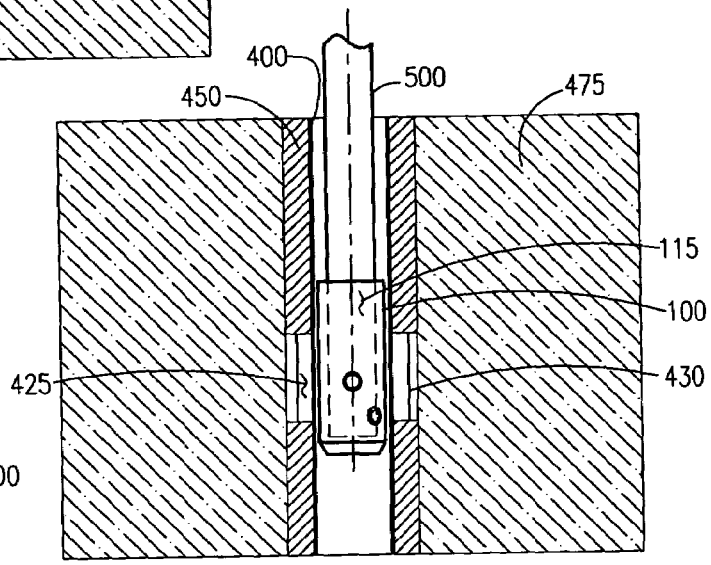
FIG. 7 is a schematic view as in FIG. 6, but at a later stage of the well perforating operation.

Also, it is preferred that lateral ports 120 are provided spaced longitudinally of the perforating tool 100 in the circumferential wall thereof, in order to provide a perforation or groove 425 (FIG. 7) in the well casing 400 of sufficient width to accommodate a terminal portion 206 of the lateral channel alignment tool 200 (discussed below). It is noted that a net moment may result due to the longitudinal spacing of the ports 120 along the length of the perforating tool 100, which moment would tend to cause the tool 100 to rotate about an axis perpendicular to its longitudinal axis 101. However, such a moment is countered by the upset tubing 500 which extends from the surface generally along the longitudinal axis 101, and is rigidly connected to the perforating tool 100. Conversely, the upset tubing 500 is relatively ineffective to prevent lateral movement of the perforating tool 100 downhole, which is why it is desired the ports 120 be provided so the lateral force vectors from jetting fluid balance out.

The well perforating tool 100 can be supplied in a multitude of dimensions depending on the diameter of the well casing that is to be perforated. Generally, it is preferred the perforating tool 100 be provided such that its OD is slightly smaller than the ID of the well casing so the tool 100 slides readily down into the well casing until the desired depth has been reached. For example, for standard 4⅛" well casing, the perforating tool 100 can have an OD of 3¾" to 4¹⁄₁₆", and more preferably about 3⅞" to about 4¹⁄₃₂". It will be understood the OD of the perforating tool 100 is provided to effect smooth rotation thereof within the well casing during a well perforation operation. From the present disclosure, a person of ordinary skill in the art can, without undue experimentation, make a perforating tool 100 having appropriate dimensions to suit the particular well casing in a particular well.

Figure 4A:
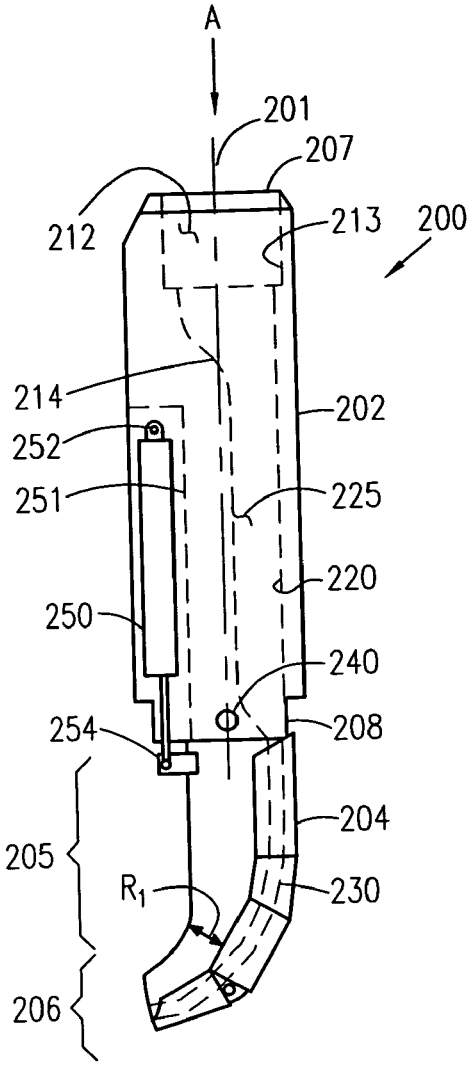
FIG. 4*a* is a side view of a lateral channel alignment tool, with the lateral alignment member pivoted in an extended position.
Figure 4B:
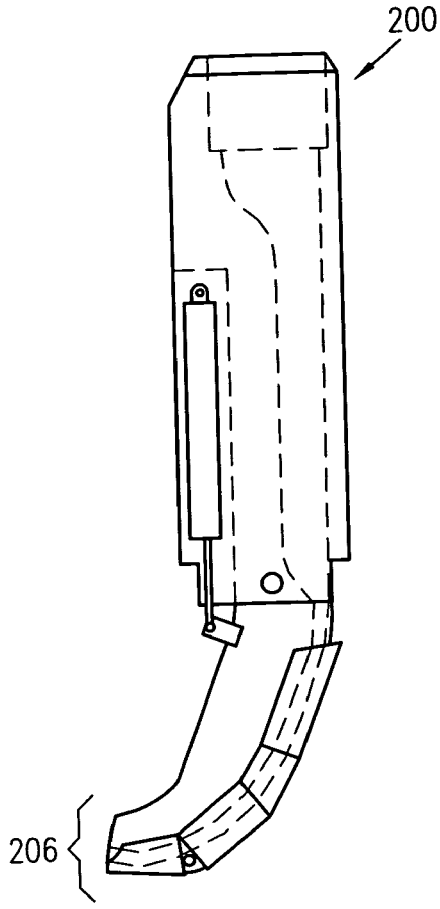
FIG. 4*b* is a side view as in FIG. 4*a*, but with the lateral alignment member pivoted in a laterally engaged position.
Figure 5:
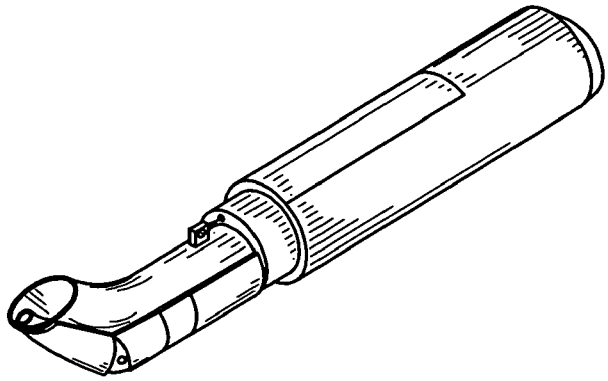
FIG. 5 is a front perspective view of the lateral channel alignment tool of FIG. 4.

Referring now to FIGS. 4*a*, 4*b*, and 5, the lateral channel alignment tool 200 has a substantially elongate basic body 202 of generally cylindrical shape having a proximal end 207 and a distal end 208, and a lateral alignment member 204 pivotally attached to the basic body 202 at or adjacent the distal end 208 via a fulcrum or pivot joint 240. The basic body 202 preferably is made from a round steel billet. The body 202 has a longitudinal through bore 220 drilled therethrough, which defines a longitudinal passage 225 adapted to accommodate a blaster nozzle and associated high pressure hose (later described). The basic body 202 preferably is further machined at its proximal end 207 to accommodate or be mated to the end of a length of upset tubing (not shown) as is known in the art. As seen in FIG. 4*a*, the machined opening 212 adjacent the proximal end 207 preferably includes a mating portion 213 for mating the upset tubing, and a neck potion 214 to provide a smooth transition and fluid communication between the mating portion 213 and the through bore 220.

Most preferably, the through bore 220, and therefore the longitudinal passage 225, is radially offset relative to the longitudinal axis 201 of the body 202. Typically, the longitudinal passage 225 has a smaller diameter than the mating portion 213 because the blaster nozzle and hose that must be accommodated by the passage 225 are of smaller diameter than the upset tubing that must be accommodated by the mating portion 213—typically 2⅜" to 2⅞" diameter. Therefore, the machined mating portion 213 is provided more centrally (though not necessarily concentrically) in the proximal end 207 of the basic body 202 to accommodate its larger diameter. In this construction, as seen in FIG. 4*a*, the neck portion 214 is provided as a reducing portion in order to provide a smooth transition between the larger diameter of the more centrally aligned mating portion 213 and the smaller diameter of the radially offset through bore 220. The through bore 220 (longitudinal passage 225) is radially offset in order to accommodate larger diameter high pressure hose, and consequently greater drilling fluid flow rates, for boring a lateral channel into the earth's strata than has heretofore been possible or practical in the art as will be described.

The lateral alignment member 204 is pivotally attached to the basic body 202 at or adjacent the distal end 208 via fulcrum or pivot joint 240. The lateral alignment member 204 has a generally elbow shape, including a major or first portion 205 that extends generally lengthwise, and a terminal portion 206 that extends transversely on or at an angle relative to the lengthwise direction of the first portion 205. An elbow-shaped passage 230 is provided within the lateral alignment member 204, extending through the respective first and terminal portions 205 and 206 thereof, from an entrance located adjacent the pivot joint 240 along a substantially arcuate path to an exit located in the terminal portion 206. The entrance of the elbow-shaped passage 230 is located adjacent the distal end of the longitudinal passage 225 in the basic body 202, and is adapted to receive a blaster nozzle and associated high pressure hose therefrom. Thus received, the elbow-shaped passage 230 is adapted to direct the blaster nozzle and hose out the exit located in the terminal portion 206 and out into the earth strata to complete a lateral channel boring operation in the adjacent formation (described below).

The lateral alignment member 204 preferably is machined from A-2 or D-2 tool steel, and is machined in two mirror-image or clamshell halves via conventional techniques to provide the above-described construction. When made as clamshell halves, the two halves are fastened to one another, e.g., using socket head cap screws. The member 204 preferably is heat treated to acquire a hardness of 55-65 RC.

The alignment tool 200 includes a biasing mechanism effective to bias the lateral alignment member 204 in an angled or laterally engaged position relative to the basic body 202 as shown in FIG. 4*b*. In the illustrated embodiment, the biasing mechanism is a pneumatic or hydraulic compression cylinder 250 attached to first and second tensioning brackets 252 and 254 located respectively on the basic body 202 and lateral alignment member 204. Compression cylinders generally are well known in the art, and the particular compression cylinder used (e.g. $N_2$, air, other gas, hydraulic, etc.) is not critical so long as it has the tendency to pull the brackets 252 and 254 closer together and thus bias the member 204 in the laterally engaged position shown in FIG. 4*b*. The first and second tensioning brackets 252 and 254 preferably are located on the respective body 202 and member 204 such that they extend generally in the same radial direction (when viewed along an end of the basic body 202—arrow A in FIG. 4*a*) as the transversely extending terminal portion 206 of the member 204. The pivot joint or fulcrum 240 between the body 202 and member 204 is arranged such that the lateral alignment member 204 pivots along an arc located in a plane with the first and second tensioning brackets 252 and 254. When a compression cylinder 250 is used as the biasing mechanism, preferably the basic body 202 has a cylinder pocket 251 provided or machined therein to accommodate the cylinder 250 within the overall geometric dimensions of the body 202, thereby facilitating unobstructed insertion of the entire assembly downhole.

With the construction described in the preceding paragraph, when the lateral channel alignment tool 200 is provided downhole within a well casing, the compression cylinder 250 urges or forces the terminal portion 206 of the lateral alignment member 204 (and correspondingly the exit of the elbow-shaped passage 230) toward an engaged position in a lateral direction radially outward relative to the longitudinal axis of the basic body 202 and against the well casing. (FIG. 4*b* shows the alignment tool 200 in the engaged position). Alternatively, other suitable biasing mechanisms can be used to achieve this effect, for example a torsion spring located at or coupled to the pivot joint 240, spring clips, helical spring or elastic band connected to the brackets 252 and 254, or any other suitable or conventional means. In order to insert the tool 200 into the well casing, the lateral alignment member 204 is forced into an extended position against the action of the biasing mechanism (compression cylinder 250), shown in FIG. 4*a*, such that the basic body 202 and member 204 are substantially longitudinally aligned to facilitate insertion of the tool 200. Once in the well casing, the external force holding the member 204 in the extended position is removed, and the terminal portion 206 is forced against the well casing by operation of the compression cylinder 250.

Methods for completing lateral channels from an existing well will now be described.

Figure 6:
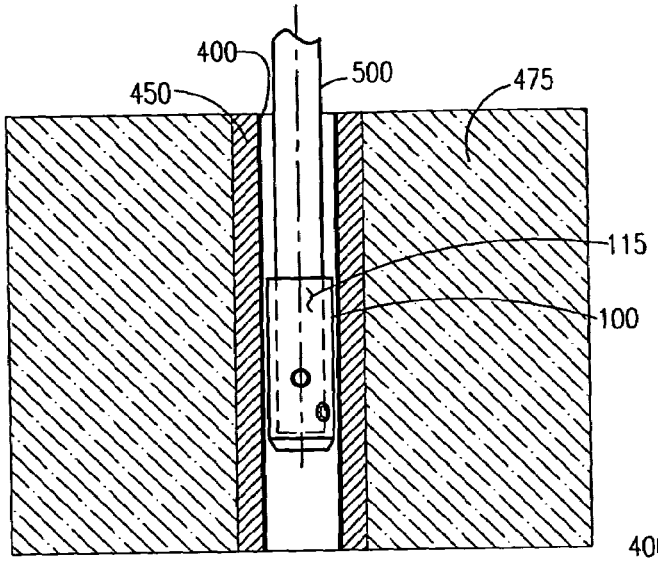
FIG. 6 is a schematic view showing the well perforating tool of FIG. 1 lowered into the well casing of an existing oil or gas well at an early stage of a well perforating operation.

Referring first to FIG. 6, a conventional cement and steel encased oil or gas well is depicted schematically, having a steel well casing 400, an annular cement encasement 450, and showing the earth strata (oil bearing formation) 475 beyond. First, the well perforating tool 100 is connected to the distal end of a length of upset tubing 500 via suitable attachment means as previously described. The perforating tool 100 is lowered into the well casing 400 via the upset tubing 500 to a depth at which it is desired to perforate the casing and complete a lateral channel into the adjacent formation 475. The perforating tool 100 is suspended at the desired depth at the end of the upset tubing 500. On the surface, the upset tubing is connected to a high pressure abrasive cutting fluid source (not shown), capable of supplying high pressure cutting fluid at a pressure of 1000-10,000 psi, preferably 2000-8000 psi, more preferably about 2500 to 5000 psi. A suitable or conventional swivel tool as known in the art (also not shown) is coupled to the proximal end of the upset tubing 500 extending out from the well casing at the earth surface. The swivel tool is engaged, and supplies torque to the upset tubing 500, which in turn supplies torque to the perforating tool 100 downhole to rotate the tool 100. The swivel tool is operated to achieve a rotational velocity for the perforating tool 100 of 5-500, preferably 10-250, preferably 15-200, preferably 15-150, RPMs. Alternatively to a swivel tool at the surface, torque can be supplied to rotate the perforating tool 100 from a downhole motor as known in the art.

The high pressure cutting fluid source is engaged, and pumps abrasive cutting fluid through the upset tubing 500, and into the axial flow passage 115 of the tool 100, such that the cutting fluid is caused to jet out from the lateral ports 120 under high pressure and impinge against the well casing 400, preferably at 2500-5000 psi. The abrasive cutting fluid can be any known or conventional cutting fluid suitable to abrade and perforate the well casing 400.

As the tool 100 rotates and jets of the high pressure abrasive cutting fluid impinge on the well casing 400, the jets continually abrade and degrade the well casing 400 about its entire circumference along a 360° path. The tool 100 continues to rotate, and the cutting fluid is continuously pumped for a period of time, preferably 5-60, more preferably about 10-40 or 10-30 minutes, depending on the material and the integrity of the well casing 400, until ultimately the casing 400 and the cement encasement 450 surrounding the casing 400 have been worn away about the entire 360° circumference thereof. The results are a substantially severed well casing 400 and cement encasement 450 (see FIG. 7), yielding a circular perforation or groove 425 in the casing 400 and cement encasement 450 at the depth at which the perforating operation was performed. It is noted the upper portions of the now-severed well casing 400 and cement encasement 450 generally will not fall, thus closing the newly made groove 425, because these will remain suspended, held up by the surrounding earth. However, for relatively newer wells where the earth has not yet sufficiently bound to the encasement to prevent collapse, or otherwise for grooves 425 made at great depths, it is desirable to place one or a plurality of support members 430 in the groove 425 to support the upper portions of the severed casing 400 and cement encasement 450 to prevent collapse.

Alternatively, the circular perforation or groove 425 can be provided by the following, alternative method. Once the perforating tool 100 has been lowered to the appropriate depth at which it is desired to provide the groove 425, the abrasive cutting fluid is pumped into the axial flow passage 115, causing jets from the lateral ports 120 as before to impinge against the well casing 400. In this method, the well perforating tool 100 is alternately extended and withdrawn (i.e. translated alternately upward and downward) a certain distance corresponding to the desired overall height of the finished groove 425, such that the impinging jets against the well casing 400 cut a vertical slot through the casing 400. Once the vertical slot has been completed, the perforating tool 100 is rotated within the well casing incrementally such that the lateral port(s) 120 is/are aligned with a portion of the casing immediately adjacent the previously cut vertical slot. Then the jetting and alternate vertical translating steps are repeated to cut a subsequent vertical slot in the well casing, that is located circumferentially adjacent the prior-cut vertical slot, such that the vertical slots together define a substantially continuous opening through the casing. This operation is repeated ultimately until a substantially continuous circular perforation or groove is provided in the casing. In this embodiment, only one lateral port 120 may be necessary in the circumferential wall of the perforating tool 100 because the height of the groove 425 is provided based on the upward/downward translation of the tool 100. However, it may be desirable to provide multiple ports 120 at the same longitudinal elevation but at a different circumferential location, such as 180° offset, in order to improve cutting efficiency or time to produce the groove 425.

In a further alternative method, the circular perforation or groove 425 can be provided by simultaneously rotating, and translating alternately upward and downward, the well perforating tool 100 as the jets of the high pressure abrasive cutting fluid emerge from the ports 120 and impinge on the well casing 400. During this operation, the jets continually abrade and degrade the well casing 400 about its entire circumference along a 360° path based on the rotation of the perforating tool 100. At the same time, a groove 425 having a desired overall height is provided based on the upward/downward translation of the perforating tool 100 as it is rotated.

Figure 8:
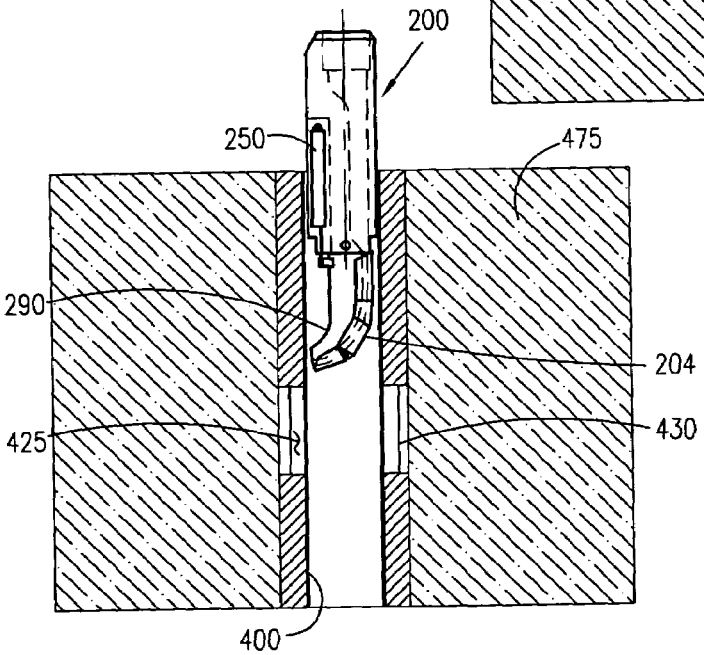
FIG. 8 is a schematic view showing the lateral channel alignment tool of FIG. 4 lowered into the well casing of an existing well after a well perforating operation, shown at an early stage of a lateral channel boring operation.

Once the circular perforation or groove 425 has been completed, the perforating tool 100 is withdrawn from the well casing and the lateral channel alignment tool 200 is lowered in its place. As shown in FIG. 8, the alignment tool 200 is attached to the end of upset tubing (not shown) and lowered into the well casing 400 where the well perforating operation was previously performed. To insert the alignment tool 200 into the well casing, first the lateral alignment member 204 is pivoted in the extended position against the action of the biasing mechanism (compression cylinder 250) via an external force. Next, the tool 200 is inserted into the well casing and the external force is removed, so that the basic body 202 is substantially slidably disposed in the well casing 400 and the lateral alignment member 204 is biased such that the terminal portion 206 is forced up against the casing 400 at a position generally below the basic body 202.

Figure 9:
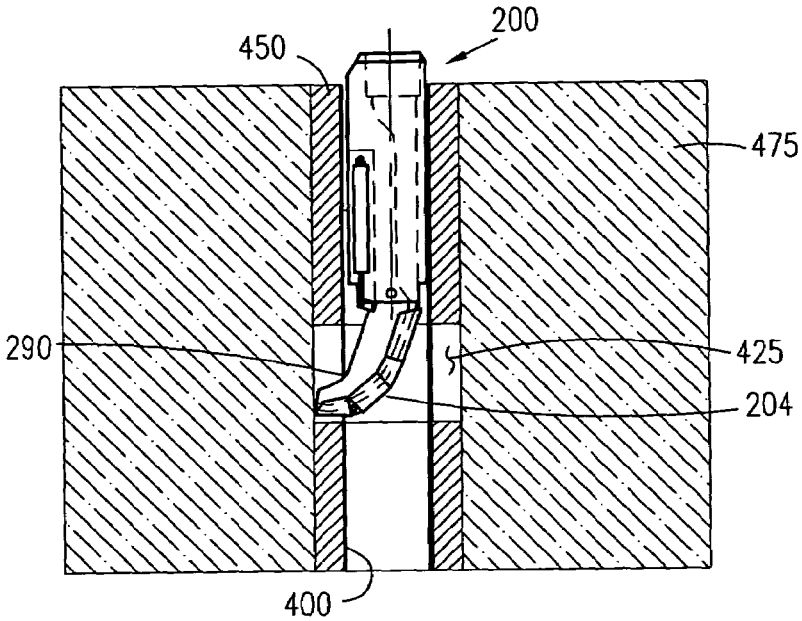
FIG. 9 is a schematic view as in FIG. 8, but at a later stage of the lateral channel boring operation.

With the terminal portion 206 forced against the well casing 400, the alignment tool 200 is pushed downward via the upset tubing from the surface, until the terminal portion 206 arrives at the previously made groove 425 in the casing 400 and the cement encasement 450. As the alignment tool 200 continues downward, due to the biasing of the lateral alignment member 204 the terminal portion 206 is caused to move laterally, and ultimately to lock into place in a laterally engaged position (FIG. 4*b*) within the groove 425 adjacent the severed upper and lower portions of the casing and cement encasement. (See FIG. 9) Thus the lateral alignment member 204, and hence the alignment tool 200, automatically locks into place on reaching the groove 425, and the exit of the elbow-shaped passage 230 is now provided adjacent, preferably substantially up against, the earth formation 475 located laterally of the severed casing.

With the lateral alignment member 204 in this position, a blaster nozzle 300 is fed down through the upset tubing at the end of a length of high pressure hose 310, such as coil tubing or macaroni tubing as known in the art. On reaching the basic body 202, the blaster nozzle 300 is fed through the machined opening 212 adjacent the proximal end 207 of the basic body 202, into and through the longitudinal passage 225, into the entrance of the elbow-shaped passage 230, and through that passage 230 to the exit thereof located in the terminal portion 206, which is positioned and oriented laterally against the earth formation in which a lateral channel is to be completed.

Figure 10:
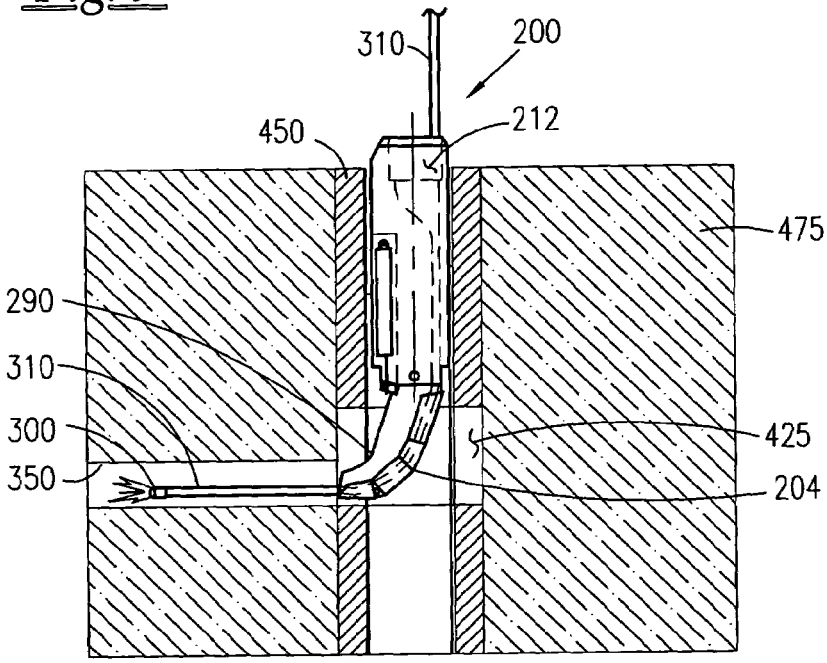
FIG. 10 is a schematic view as in FIG. 9 but at a still later stage of the lateral channel boring operation.

Next, high pressure drilling fluid is pumped through the high pressure hose 310, down to the blaster nozzle 300 at the end thereof, so that the blaster nozzle 300 can bore a lateral channel 350 from the existing well adjacent the location where the well casing and cement encasement previously were severed (See FIG. 10). Nozzle blaster operations using high pressure fluid, such as water with or without abrasive component additives at pressures ranging from 2000-25,000 psi, generally are known in the art, and are described, e.g., in the aforementioned U.S. patents which have been incorporated herein. Generally, any suitable blaster nozzle and/or high pressure hose can be used so long as the blaster nozzle and hose can negotiate the longitudinal passage 225 and the elbow-shaped passage 230 of the lateral channel alignment tool 200. High pressure hose 310 is fed continuously from the surface until a lateral channel 350 of desired length has been completed, at which point the hose 310 is withdrawn at least to a sufficient extent to withdraw the blaster nozzle 300 from the newly bored lateral channel 350 in the earth strata. If it is desired to complete more than one lateral channel at the same depth, then the alignment tool 200 simply is rotated from the previously completed lateral channel and the process is repeated for a second lateral channel, and a third, and so on. It will be evident one can complete multiple lateral channels at a given depth without having to repeat a well perforating operation.

To remove the alignment tool 200, it is simply withdrawn in a conventional manner. The curved transition surface 290 between the first and terminal portions 205 and 206 acts as a cammed surface essentially forcing the alignment member 204 back into the extended position so that it can be withdrawn from the well casing. Alternatively, if it is desired to feed the alignment tool 200 deeper than the groove 425, for example down to a deeper groove 425 cut in the same well to complete additional lateral channels at a greater depth, the biasing mechanism can be provided such that it can be actuated to retain the member 204 in the extended position until the terminal portion 206 has exceeded the depth of the first groove. Then the biasing mechanism is de-actuated and once again is effective to bias the member 204, and terminal portion 206, against the well casing so it will automatically lock into place when the next-deeper groove in the casing 400 is reached. Servos and other actuating mechanisms and methods generally are known in the art. For example, when a gas or hydraulic compression cylinder 250 is used, gas or hydraulic pressure can be supplied or withdrawn via a hydraulic fluid line or gas manifold based on actuation signals from an operator. The implementation of such methods is within the skill of a person having ordinary skill in the art, and will not be described further here.

The disclosed tools and methods provide several advantages over conventional lateral drilling systems and techniques. One such advantage is that it is not necessary to maintain any downhole equipment at the exact depth and in precise alignment with a previously cut small hole through the well casing in order to align the blaster nozzle with the previously cut hole. With the apparatus herein described, once the well perforating operation has been completed and the well casing has been severed or perforated as described above, the alignment tool 200 is inserted downhole into the well casing and automatically locks into place once it reaches the previously made well perforation. Furthermore, because the well is severed/perforated substantially about its entire circumference, a lateral channel boring operation can be performed in any compass direction radially outward from the well casing and it is not necessary to maintain the precise compass alignment of the alignment tool 200. In addition, once a lateral channel has been bored in one compass direction, the blaster nozzle and hose can be withdrawn into the alignment member 204, the tool 200 can be rotated to another compass direction, and an additional drilling operation or operations can be performed at the same depth in different compass directions without having to drill additional holes or repeat a well perforating operation in the well casing.

A further advantage is that a larger diameter high pressure hose and blaster nozzle can be used for boring a lateral channel in the earth strata from an existing oil or gas well than previously was possible with conventional equipment in a well having the same diameter. This is because, conventionally, the downhole "shoe" for redirecting the blaster nozzle and associated high pressure hose incorporated a longitudinal channel for receiving the blaster nozzle and high pressure hose that was substantially centrally aligned along the longitudinal axis of the well casing. Conversely, as can be see in FIG. 4*a*, the longitudinal passage 225 and the longitudinal portion of the elbow-shaped passage 230 are radially offset from the longitudinal axis 201. In this construction, the radius of curvature $R_1$ (FIG. 4*a*) for the pathway of the high pressure hose is substantially increased compared to the case when the longitudinal passage is provided centered on the longitudinal axis. As a result, larger diameter high pressure hose can be employed to bore lateral channels into the earth strata, because the high pressure hose does not need to bend as tightly to be redirected in a lateral direction, so the binding that otherwise would occur from tightly bending a larger diameter hose is avoided. One advantage of larger diameter high pressure hose is that higher volume flowrates of drilling fluid can be accommodated in the hose. This is particularly useful when a portion of the drilling fluid is used to provide forward thrust to the hose and the blaster nozzle via thrusters provided in the hose (described below), because high pressure jets of the fluid can exit the thrusters to thrust the blaster nozzle forward without substantially sacrificing the flow rate and pressure of the drilling fluid in the blaster nozzle used to bore the lateral channel.

Figure 14:
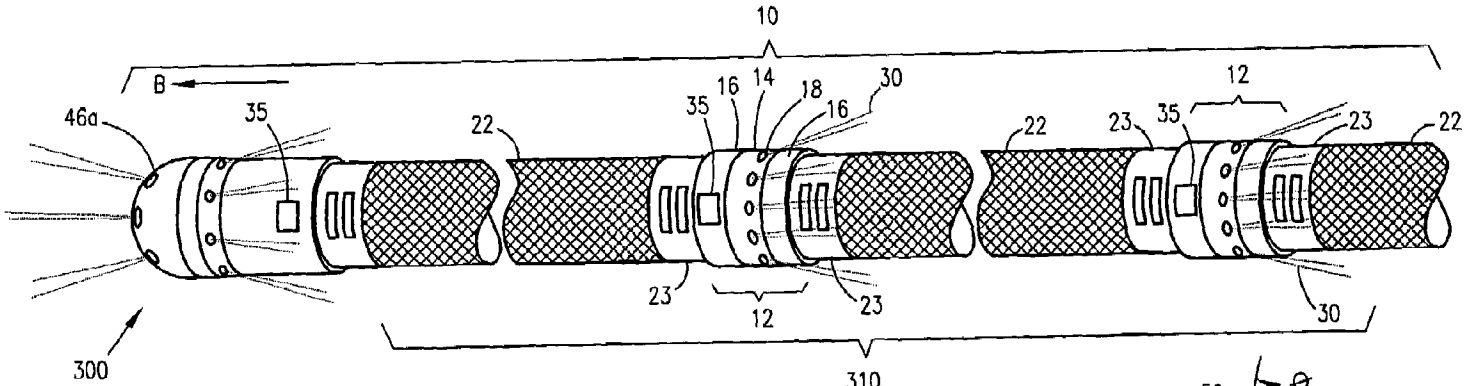
FIG. 14 is a perspective view of a flexible hose having thruster couplings.

In one embodiment, the high pressure hose includes or is provided as a flexible hose assembly comprising a flexible hose with thrusters and a blaster nozzle coupled to and in fluid communication with the terminal end of the hose. With reference to FIG. 14, there is shown generally a flexible hose assembly 10 for completing a lateral channel in a general direction indicated by the arrow B, which preferably comprises a blaster nozzle 300 and a high pressure hose 310. High pressure hose 310 includes a plurality of flexible hose sections 22, a pair of pressure fittings 23 attached to the ends of each hose section 22, and a plurality of thruster couplings 12, each of which joins a pair of adjacent pressure fittings 23. Hose assembly 10 comprises a blaster nozzle 300 at its distal end and is connected to a source (not shown) of high pressure drilling fluid, preferably an aqueous drilling fluid, preferably water, less preferably some other liquid, at its proximal end. Couplings 12 are spaced at least, or not more than, 5, 10, 20, 30, 40, 50, 60, 70, 80, 90 or 100 feet apart from each other in hose 310. The total hose length is preferably at least or not more than 100 or 200 or 400 or 600 or 700 or 800 or 900 or 1000 or 1200 or 1400 or 1600 or 1800 or 2000 feet. Hose sections 22 are preferably flexible hydraulic hose known in the art, comprising a steel braided rubber-TEFLON (polytetrafluoroethylene) mesh, preferably rated to withstand at least 5,000, preferably at least 10,000, preferably at least 15,000, psi water pressure. High pressure drilling fluid is preferably supplied at at least 2,000, 5,000, 10,000, 15,000, or 18,000 psi, or at 5,000 to 10,000 to 15,000 psi. When used to drill laterally from a well, the hose extends about or at least or not more than 7, 10, 50, 100, 200, 250, 300, 350, 400, 500, 1000, or 2000 feet laterally from the original well. In one embodiment the hose extends about 440 feet laterally from the original well.

Figure 11:
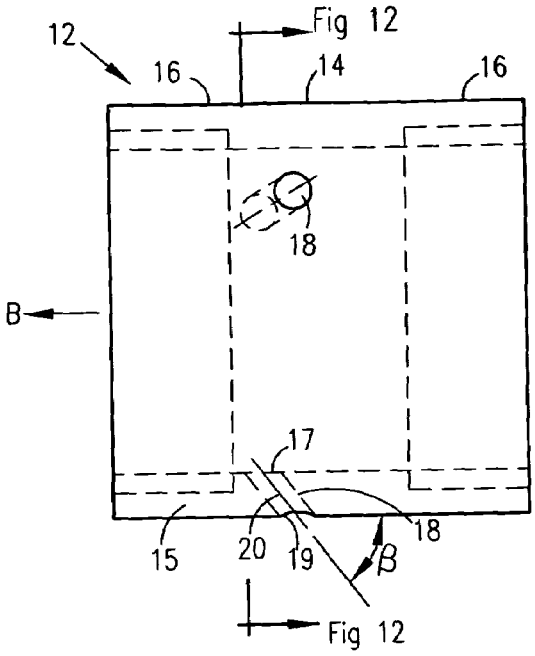
FIG. 11 is a side view of a thruster coupling according to an aspect the invention.

As illustrated in FIG. 11, in one embodiment a thruster coupling 12 comprises a coupling or fitting, preferably made from metal, preferably steel, most preferably stainless steel, less preferably aluminum. Less preferably, coupling 12 is a fitting made from plastic, thermoset, or polymeric material, able to withstand 5,000 to 10,000 to 15,000 psi of water pressure. Still less preferably, coupling 12 is a fitting made from ceramic material. It is important to note that when a drilling fluid other than water is used, the material of construction of the couplings 12 must be selected for compatibility with the drilling fluid and yet still withstand the desired fluid pressure. Coupling 12 has two threaded end sections 16 and a middle section 14. Preferably, end sections 16 and middle section 14 are formed integrally as a single solid part or fitting. Threaded sections 16 are female-threaded to receive male-threaded pressure fittings 23 which are attached to, preferably crimped within the ends of, hose sections 22 (FIG. 14).

Alternatively, the fittings 23 can be attached to the ends of the hose sections 22 via any conventional or suitable means capable of withstanding the fluid pressure. In the illustrated embodiment, each fitting 23 has a threaded portion and a crimping portion which can be a unitary or integral piece, or a plurality of pieces joined together as known in the art. Alternatively, the threaded connections may be reversed; i.e. with male-threaded end sections 16 adapted to mate with female-threaded pressure fittings attached to hose sections 22. Less preferably, end sections 16 are adapted to mate with pressure fittings attached to the end of hose sections 22 by any known connecting means capable of providing a substantially water-tight connection at high pressure, e.g. 5,000-15,000 psi. Middle section 14 contains a plurality of holes or thruster ports 18 which pass through the thickness of wall 15 of coupling 12 to permit water to jet out. Though the thruster ports 18 are shown having an opening with a circular cross-section, the thruster port openings can be provided having any desired cross section; e.g. polygonal, curvilinear or any other shape having at least one linear edge, such as a semi-circle.

Coupling 12 preferably is short enough to allow hose 310 to traverse the elbow-shaped passage 230 in the alignment member 204. Therefore, coupling 12 is formed as short as possible, preferably having a length of less than about 3, 2, or 1.5 inches, more preferably about 1 inch or less than 1 inch. Hose 310 (and therefore couplings 12 and hose sections 22) preferably has an outer diameter of about 0.25 to about 3 inches, more preferably about 0.375 to about 2.5 inches, and an inner diameter preferably of about 0.5-2 inches. Couplings 12 have a wall thickness of preferably about 0.025-0.25, more preferably about 0.04-0.1, inches.

Figure 16:
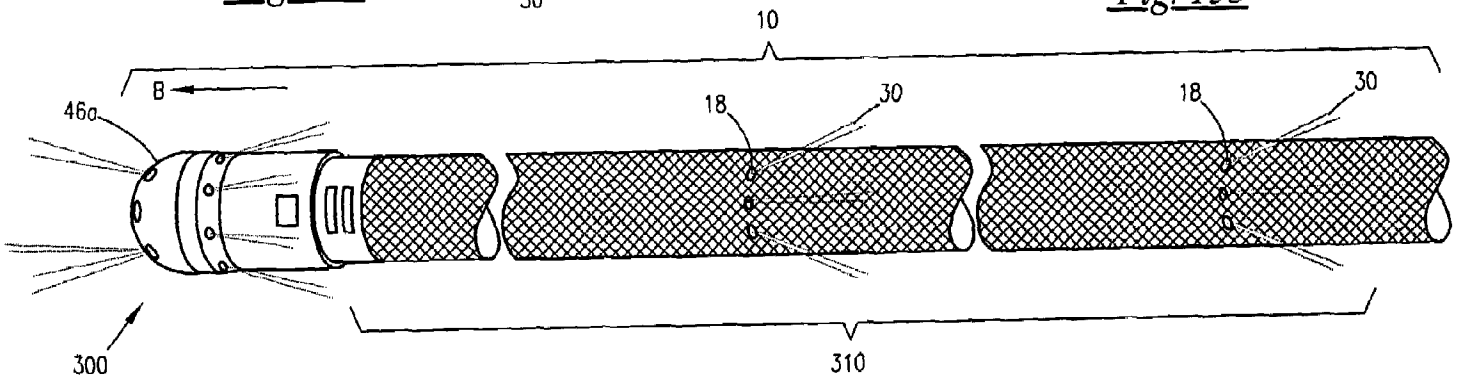
FIG. 16 is a perspective view of a flexible hose having thruster ports provided directly in the sidewall according to an embodiment of the invention.

Optionally, hose 310 is provided with couplings 12 formed integrally therewith, or with thruster ports 18 disposed directly in the sidewall of a contiguous, unitary, non-sectioned hose at spaced intervals along its length (see FIG. 16). A hose so comprised obviates the need of threaded connections or other connecting means as described above.

Figure 12:
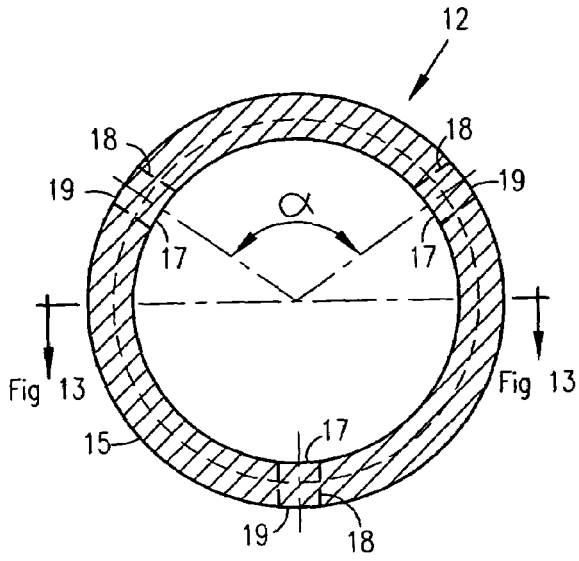
FIG. 12 is a cross-sectional view of the thruster coupling taken along line 12-12 in FIG. 11.
Figure 17:
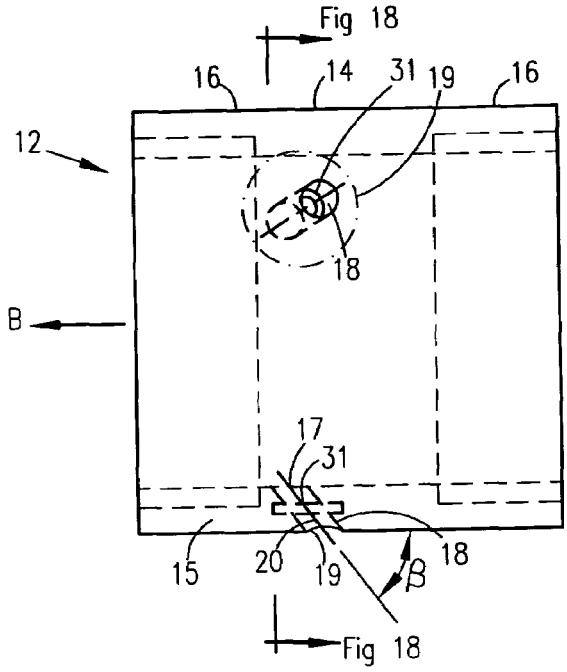
FIG. 17 is a side view of a thruster coupling having adjustable thruster ports according to an embodiment of the invention.

In the embodiments shown in FIGS. 11 and 17, thruster ports 18 have hole axes 20 which form a discharge angle $\beta$ with the longitudinal axis of the coupling 12. The discharge angle $\beta$ is preferably 5° to 90°, more preferably 10° to 90°, more preferably 10° to 80°, more preferably 15° to 70°, more preferably 20° to 60°, more preferably 25° to 55°, more preferably 30° to 50°, more preferably 40° to 50°, more preferably 40° to 45°, more preferably about 45°. The thruster ports 18 are also oriented such that a jet of drilling fluid passing through them exits the coupling 12 in a substantially rearward direction; i.e. in a direction such that a centerline drawn through the exiting jet forms an acute angle (discharge angle $\beta$) with the longitudinal axis of the flexible hose rearward from the location of the thruster port, toward the proximal end of the hose assembly. In this manner, high-pressure jets 30 emerging from thruster ports 18 impart forward drilling force or thrust to the blaster nozzle, thus forcing the blaster nozzle forward into the earth strata (see FIG. 14). As illustrated in FIG. 12, a plurality of thruster ports 18 are disposed in wall 15 around the circumference of coupling 12. There are 2 to 6 or 8 ports, more preferably 3 to 5 ports, more preferably 3 to 4 ports. Thruster ports 18 are spaced uniformly about the circumference of coupling 12, thus forming an angle $\alpha$ between them. Angle $\alpha$ will depend on the number of thruster ports 18, and thus preferably will be from 45° or 60° to 180°, more preferably 72° to 120°, more preferably 90° to 120°. Thruster ports 18 are preferably about 0.010 to 0.017 inches, more preferably 0.012 to 0.016 inches, more preferably 0.014 to 0.015 inches in diameter.

Figure 13:
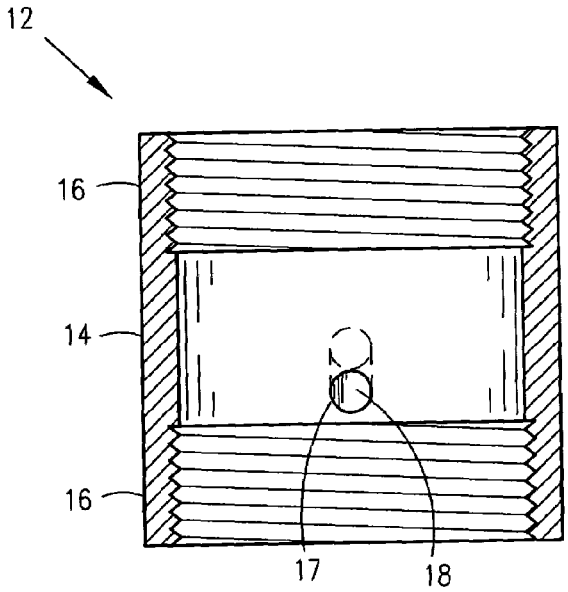
FIG. 13 is a longitudinal cross-sectional view of the thruster coupling taken along line 13-13 in FIG. 12.

As best seen in FIGS. 11-13, thruster ports 18 are formed in the wall 15 of coupling 12, extending in a substantially rearward direction toward the proximal end of the hose assembly 10, connecting inner opening 17 at the inner surface of wall 15 with outer opening 19 at the outer surface of wall 15. The number of couplings 12, as well as the number and size of thruster ports 18 depends on the desired drilling fluid pressure and flow rate. If a drilling fluid source of only moderate delivery pressure is available, e.g. 5,000-7,000 psi, then relatively fewer couplings 12 and thruster ports 18, as well as possibly smaller diameter thruster ports 18 should be used. However, if higher pressure drilling fluid is supplied, e.g. 10,000-15,000 psi, then more couplings 12 and thruster ports 18 can be utilized. The number of couplings 12 and thruster ports 18, the diameter of thruster ports 18, and the initial drilling fluid pressure and flow rate are all adjusted to achieve flow rates through blaster nozzle 300 of 1-10, more preferably 1.5-8, more preferably 2-6, more preferably 2.2-3.5, more preferably 2.5-3, gal/min. It is also to be noted that because larger diameter hose can be used than conventionally was possible, larger diameter or a greater number of thruster ports 18 also can be used to supply greater drilling thrust without adversely impacting the pressure or flow rate of drilling fluid at the blaster nozzle. This is a substantial advancement over the prior art.

In one embodiment illustrated in FIG. 11, the thruster ports 18 are provided as unobstructed openings or holes through the side wall of the thruster coupling 12. The ports 18 are provided or drilled at an angle so that the exiting pressurized fluid jets in a rearward direction as explained above.

Figure 18:
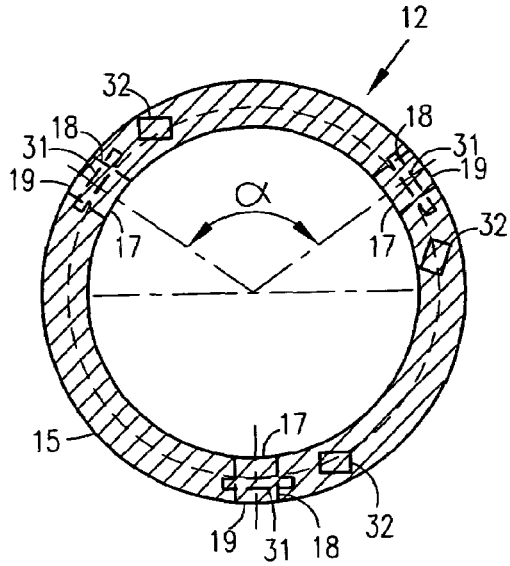
FIG. 18 is a cross-sectional view of the thruster coupling taken along line 18-18 in FIG. 17.
Figure 19:
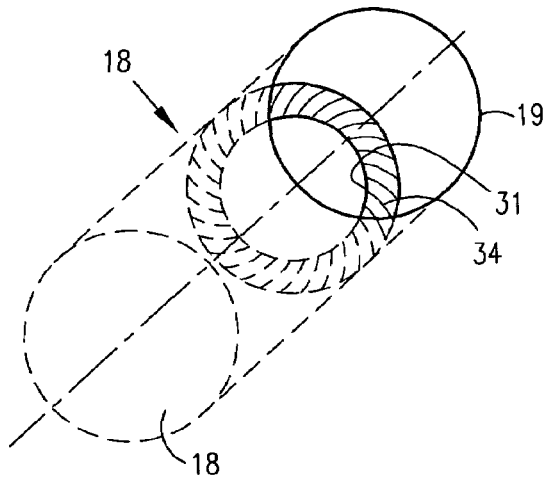
FIG. 19 is a close-up view of an adjustable thruster port indicated at broken circle 19 in FIG. 17.

In a further embodiment illustrated in FIG. 17, the thruster couplings 12 and thruster ports 18 are similarly provided as described above shown in FIG. 11, except that the thruster ports 18 are adjustable, including a shutter 31. The shutter 31 is preferably an iris as shown in FIG. 17, and shown close-up in FIG. 19. The shutter 31 is actuated by a servo controller 32 (pictured schematically in the figures) which is controlled by an operator at the surface via wireline, radio signal or any other suitable or conventional means. The servo controller 32 is preferably provided in the sidewall of the coupling 12 as shown in FIG. 18, or is mounted on the inner wall surface of the coupling 12. The servo controller 32 has a small stepping motor to control or actuate the shutter 31 to thereby regulate the diameter or area of the opening 34 for the thruster port 18. A fully open shutter 31 results in the maximum possible thrust from the associated thruster port 18 because the maximum area is available for the expulsion of high pressure fluid. An operator can narrow the opening 34 by closing the shutter 31 to regulate the amount of thrust imparted to the hose assembly by the associated thruster port 18. The smaller diameter the opening 34, the less thrust provided by the thruster port 18. Although an iris is shown, it will be understood that other mechanisms can be provided for the shutter 31 which are conventional or which would be recognized by a person of ordinary skill in the art; e.g. sliding shutter, flap, etc. The servo controller 32 is preferably a conventional servo controller having a servo or stepping motor that is controlled in a conventional manner. Servo controllers are generally known or conventional in the art.

In addition to providing thrust, the thruster ports 18 also provide another desirable function. Thruster ports 18 keep the bore clear behind blaster nozzle 300 as the rearwardly jetting high pressure drilling fluid (water) washes the drill cuttings out of the lateral bore so that the cuttings do not accumulate in the lateral bore. The high pressure drilling fluid forced through the thruster ports 18 also cleans and reams the bore by clearing away any sand and dirt that has gathered behind the advancing blaster nozzle 300, as well as smoothing the wall of the freshly drilled bore.

This is a desirable feature because, left to accumulate, the cuttings and other debris can present a significant obstacle to lateral boring, effectively sealing the already-bored portion of the lateral bore around the advancing hose assembly 10. This can make removal of the hose assembly 10 difficult once boring is completed. In a worst case, the remaining debris can cause the lateral bore to reseal once the hose assembly 10 has been withdrawn. By forcing these cuttings rearward to exit the lateral bore, the rearwardly directed drilling fluid jets 30 ensure the lateral bore remains substantially open and clear after boring is completed and the hose assembly 10 is removed. By providing the thruster ports 18 along substantially the entire length of the hose assembly 10, drill cuttings can be driven out of the lateral bore from great distances, preferably at least 50, 100, 200, 250, 300, 350, 400, 500, 1000, or more, feet.

In one embodiment, adjustable thruster ports 18 are operated sequentially such that when a thruster port or a group of longitudinally aligned thruster ports is closed, the next-most proximal thruster port or group of longitudinally aligned thruster ports is opened, thereby sweeping cuttings in a proximal direction out from the lateral channel and into the existing well. In this method, the benefits of sweeping the cuttings out of the lateral channel are obtained, while only a relatively small number of the thruster ports 18 is open at any one time. The result is that drilling fluid pressure through the blaster nozzle is maximized, while drilling thrust and lateral channel sweeping is provided by the sequentially operated thruster ports.

Figure 15B:
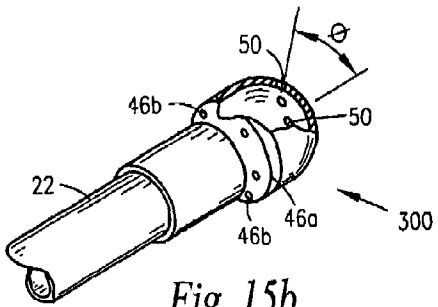
FIG. 15*b* is an alternate perspective view of a blaster nozzle.
Figure 15A:
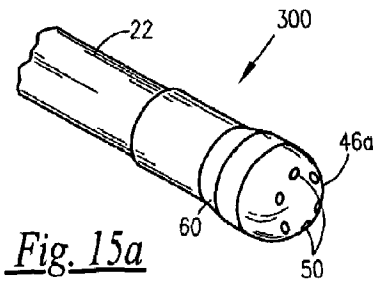
FIG. 15*a* is a perspective view of a blaster nozzle.

Blaster nozzle 300 is of any type that is known or conventional in the art, for example, the type shown in FIGS. 15*a*-15*b*. In the illustrated embodiment, blaster nozzle 300 comprises a plurality of holes 50 disposed about a front portion 46*a* which preferably has a substantially domed shape. Holes 50 are positioned to form angle θ with the longitudinal axis of blaster nozzle 300. Angle θ is 10°-30°, more preferably 15°-25°, more preferably about 20°. Blaster nozzle 300 also comprises a plurality of holes 46*b*, which are oriented in a reverse or rearward direction on a rear portion 60 of blaster nozzle 300, the direction and diameter of holes 46*b* being similar to that of thruster ports 18 disposed around couplings 12. Holes 46*b* serve a similar function as thruster ports 18 to impart forward drilling force to blaster nozzle 300 and to wash drill cuttings rearward to exit the lateral bore. Optionally, front portion 46*a* is rotatably coupled to rear portion 60, with holes 50 oriented at an angle such that exiting high-pressure drilling fluid imparts rotational momentum to front portion 46*a*, thus causing front portion 46*a* to rotate while drilling. Rear portion 60 is either fixed with respect to hose 310 unable to rotate, or is rotatably coupled to hose 310 thus allowing rear portion 60 to rotate independently of hose 310 and front portion 46*a*. In this embodiment, holes 46*b* are oriented at an angle effective to impart rotational momentum to rear portion 60 upon exit of high-pressure drilling fluid, thus causing rear portion 60 to rotate while drilling. Holes 50 and 46*b* can be oriented such that front and rear portions (46*a* and 60 respectively) rotate in the same or opposite directions during drilling.

The hose assembly 10 may be provided with a plurality of position indicating sensors 35 along its length. Position indicating sensors 35 are shown schematically in FIG. 14 attached to the thruster couplings 12 and blaster nozzle 300. Alternatively, the position indicating sensors 35 can be provided in the coupling walls, or in the hose wall along its length. The position indicating sensors 35 can emit a radio signal or can be monitored by wireline from the surface to determine the location and configuration of the flexible hose. The adjustable thruster ports 18 can be controlled based on position and configuration information received from these position indicating sensors 35. Preferably, a computer receives information from the position indicating sensors 35 and regulates the adjustable thrusters based on that information to achieve the desired position control of the hose assembly 10 as it drills a lateral bore.

Although the hereinabove described embodiments of the invention constitute preferred embodiments, it should be understood that modifications can be made thereto without departing from the spirit and the scope of the invention as set forth in the appended claims.

What is claimed is:

1. A method of completing a lateral channel from an existing oil or gas well having a well casing, comprising the steps of:

providing a well perforating tool having a substantially cylindrical body defining a circumferential wall of the perforating tool, said perforating tool having a longitudinal axis and comprising an axial blind bore open to a proximal end of said perforating tool and defining an axial flow passage within the perforating tool, and at least one lateral port located in the circumferential wall of said perforating tool, said lateral port providing fluid communication between said axial flow passage and a position exterior of said perforating tool;

suspending said well perforating tool at a selected depth in said existing well; and pumping a fluid at high pressure through said axial flow passage such that a jet of said high pressure fluid shoots out from said lateral port to make a perforation in said well casing;

translating said perforating tool alternately upward and downward while said jet is shooting out from said lateral port and simultaneously rotating said perforating tool, wherein said jet abrades and degrades the well casing to provide a substantially circular groove in said casing about a 360° path, said groove having a height based on the upward and downward translation of said perforating tool.

2. A method according to claim 1 wherein the step of rotating includes the step of incrementally rotating said perforating tool.

3. A method according to claim 2, further comprising repeating said incrementally rotating step.

4. A method according to claim 1, further comprising the steps of:

vertically repositioning said perforating tool incrementally once said circular groove has been cut through said well casing such that said lateral port is aligned with a portion of said well casing immediately adjacent said circular groove; and repeating said pumping, said translating, and said rotating steps to cut a second substantially circumferential perforation through said well casing located vertically adjacent the prior-cut circular groove, such that the prior and second circular grooves together define a substantially continuous opening through said casing.

5. A method of completing a lateral channel from an existing oil or gas well having a well casing, comprising the steps of:

providing a well perforating tool having a substantially cylindrical body defining a circumferential wall of the perforating tool, said perforating tool having a longitudinal axis and comprising an axial blind bore open to a proximal end of said perforating tool and defining an axial flow passage within the perforating tool, and at least one lateral port located in the circumferential wall of said perforating tool, said lateral port providing fluid communication between said axial flow passage and a position exterior of said perforating tool;

suspending said well perforating tool at a selected depth in said existing well; and pumping a fluid at high pressure through said axial flow passage such that a jet of said high pressure fluid shoots out from said lateral port to make a perforation in said well casing;

translating said perforating tool alternately upward and downward while said jet is shooting out from said lateral port so as to cut a substantially vertical slot through said well casing;

rotating said perforating tool within said well casing while said jet is shooting out from said lateral port so as to cut a substantially circumferential perforation through said well casing; and placing a support member into said substantially circumferential perforation to support an upper portion of said well casing.

6. A method of completing a lateral channel from an existing oil or gas well, comprising:

providing and directing a flexible hose into engagement with earth strata to cut a lateral channel through the strata from the existing well, said flexible hose comprising a plurality of adjustable thruster ports disposed at spaced intervals along the length thereof, and operating said adjustable thruster ports sequentially such that when a thruster port or a group of longitudinally aligned thruster ports is closed, the next-most proximal thruster port or group of longitudinally aligned thruster ports is opened, thereby sweeping cuttings in a proximal direction out from the lateral channel and into the existing well.

7. The method of claim 6, further comprising providing a lateral channel alignment tool comprising a substantially elongate basic body having a longitudinal axis, a lateral alignment member pivotally attached to the basic body, and a biasing mechanism effective to bias said lateral alignment member in an angled or laterally engaged position relative to said basic body, said basic body having a longitudinal passage therethrough adapted to accommodate a hose therein, said lateral alignment member comprising a first portion that extends generally lengthwise, a terminal portion that extends at an angle relative to the lengthwise direction of the first portion, and an elbow-shaped passage provided within the lateral alignment member, said elbow-shaped passage extending through said respective first and terminal portions of said alignment member from an entrance located in said first portion to an exit located in said terminal portion, said entrance of said elbow-shaped passage being located adjacent a distal end of said longitudinal passage in said basic body and being adapted to receive a blaster nozzle and associated hose therefrom; and providing and directing the flexible hose through said elbow-shaped passage in said lateral alignment member, out through the exit thereof and into engagement with earth strata beyond.

8. The method according to claim 6, further comprising providing a well perforating tool having a substantially cylindrical body defining a circumferential wall of the perforating tool, said perforating tool having a longitudinal axis and comprising an axial blind bore open to a proximal end of said perforating tool and defining an axial flow passage within the perforating tool, and at least one lateral port located in the circumferential wall of said perforating tool, said lateral port providing fluid communication between said axial flow passage and a position exterior of said perforating tool;

suspending said well perforating tool at a selected depth in said existing well;

pumping a fluid at high pressure through said axial flow passage such that a jet of said high pressure fluid shoots out from said lateral port to make a perforation in said well casing; and subsequently directing said flexible hose into engagement with said earth strata through said perforation in said well casing.

9. The method according to claim 6, said flexible hose having a blaster nozzle attached at its distal end.

10. A method of completing a lateral channel from an existing oil or gas well, comprising providing a well perforating tool having a substantially cylindrical body defining a circumferential wall of the perforating tool, said perforating tool having a longitudinal axis and comprising an axial blind bore open to a proximal end of said perforating tool and defining an axial flow passage within the perforating tool, and at least one lateral port located in the circumferential wall of said perforating tool, said lateral port providing fluid communication between said axial flow passage and a position exterior of said perforating tool;

suspending said well perforating tool at a selected depth in said existing well;

pumping a fluid at high pressure through said axial flow passage such that a jet of said high pressure fluid shoots out from said lateral port to make a perforation in said well casing;

providing and positioning in said well a lateral channel alignment tool comprising a substantially elongate basic body having a longitudinal axis, a lateral alignment member pivotally attached to the basic body, and a biasing mechanism effective to bias said lateral alignment member in an angled or laterally engaged position relative to said basic body, said basic body having a longitudinal passage therethrough adapted to accommodate a flexible hose therein, said lateral alignment member comprising a first portion that extends generally lengthwise, a terminal portion that extends at an angle relative to the lengthwise direction of the first portion, and an elbow-shaped passage provided within the lateral alignment member, said elbow-shaped passage extending through said respective first and terminal portions of said alignment member from an entrance located in said first portion to an exit located in said terminal portion, said entrance of said elbow-shaped passage being located adjacent a distal end of said longitudinal passage in said basic body and being adapted to receive a flexible hose therefrom;

directing a flexible hose comprising a plurality of adjustable thruster ports disposed at spaced intervals along the length thereof through said elbow-shaped passage in said lateral alignment member, out through the exit thereof and into engagement with earth strata beyond to cut a lateral channel in said strata; and operating said adjustable thruster ports sequentially such that when a thruster port or a group of longitudinally aligned thruster ports is closed, the next-most proximal thruster port or group of longitudinally aligned thruster ports is opened, thereby sweeping cuttings in a proximal direction out from the lateral channel and into the existing well.

11. The method according to claim 10, said lateral alignment member being caused to be engaged within said perforation in said well casing by the action of said biasing mechanism, prior to directing said flexible hose therethrough.

12. The method according to claim 10, said flexible hose having a blaster nozzle attached at its distal end.

13. A method of completing a lateral channel from an existing oil or gas well having a well casing, comprising the steps of:

providing a well perforating tool having a substantially cylindrical body defining a circumferential wall of the perforating tool, said perforating tool having a longitudinal axis and comprising an axial blind bore open to a proximal end of said perforating tool and defining an axial flow passage within the perforating tool, and at least one lateral port located in the circumferential wall of said perforating tool, said lateral port providing fluid communication between said axial flow passage and a position exterior of said perforating tool;

suspending said well perforating tool at a selected depth in said existing well; and pumping a fluid at high pressure through said axial flow passage such that a jet of said high pressure fluid shoots out from said lateral port to make a perforation in said well casing; and translating said perforating tool alternately upward and downward while said jet is shooting out from said lateral port so as to cut a substantially vertical slot through said well casing;

providing a lateral channel alignment tool comprising a substantially elongate basic body having a longitudinal axis, a lateral alignment member pivotally attached to the basic body, and a biasing mechanism effective to bias said lateral alignment member in an angled or laterally engaged position relative to said basic body, said basic body having a longitudinal passage therethrough adapted to accommodate a hose therein, said lateral alignment member comprising a first portion that extends generally lengthwise, a terminal portion that extends at an angle relative to the lengthwise direction of the first portion, and an elbow-shaped passage provided within the lateral alignment member, said elbow-shaped passage extending through said respective first and terminal portions of said alignment member from an entrance located in said first portion along an arcuate path to an exit located in said terminal portion, said entrance of said elbow-shaped passage being located adjacent a distal end of said longitudinal passage in said basic body and being adapted to receive a hose therefrom; and inserting the lateral channel alignment tool into the well casing with the lateral alignment member biased such that the terminal portion thereof is forced against the well casing, and lowering the lateral channel alignment tool downward in the well casing until the terminal portion thereof arrives at and is caused to engage and lock into place within a perforation made through said well casing using said well perforating tool.

14. A method of completing a lateral channel from an existing oil or gas well having a well casing, comprising the steps of:

providing a well perforating tool having a substantially cylindrical body defining a circumferential wall of the perforating tool, said perforating tool having a longitudinal axis and comprising an axial blind bore open to a proximal end of said perforating tool and defining an axial flow passage within the perforating tool, and a plurality of lateral ports located in the circumferential wall of said perforating tool, said lateral ports providing fluid communication between said axial flow passage and a position exterior of said perforating tool;

suspending said well perforating tool at a selected depth in said existing well;

pumping a fluid at high pressure through said axial flow passage such that a jet of said high pressure fluid shoots out from each of said lateral ports to make a perforation in said well casing;

rotating said well perforating tool within said well casing while said jets are shooting out from said lateral ports so as to cut a substantially circumferential perforation through said wall, wherein the lateral ports are positioned so that the jets impart a net torque on the cylindrical body that tends to cause the cylindrical body to rotate about an axis that is perpendicular to said longitudinal axis, while a net lateral force on the cylindrical body due to said jets is substantially zero.

15. The method according to claim 14, further comprising the step of, simultaneously with said rotating step, translating said well perforating tool alternately upward and downward.

16. A method of completing a lateral channel from an existing oil or gas well, comprising:

providing and directing a flexible hose into a lateral channel that opens into and extends from the existing well, said flexible hose comprising a plurality of adjustable thruster ports disposed at spaced intervals along the length thereof, and operating said adjustable thruster ports sequentially to sweep cuttings from the lateral channel in a proximal direction toward the existing well.

17. The method of claim 16, wherein the adjustable thruster ports are operated sequentially such that when a thruster port or a group of longitudinally aligned thruster ports is closed, the next-most proximal thruster port or group of longitudinally aligned thruster ports is opened, thereby sweeping cuttings in a proximal direction out from the lateral channel and into the existing well.

* * * * *